US005098098A

United States Patent [19]

Petralia

[11] Patent Number: 5,098,098

[45] Date of Patent: Mar. 24, 1992

[54] SHOCK AND VIBRATION ABSORBANT SPORTS RACKET

[76] Inventor: John W. Petralia, Rittenhouse Plaza, Philadelphia, Pa. 19103

[21] Appl. No.: 216,177

[22] Filed: Jul. 7, 1988

[51] Int. Cl.[5] ..... A63B 49/02

[52] U.S. Cl. ..... 273/73 R; 273/73 C

[58] Field of Search ..... 273/73 R, 73 C, 73 E, 273/73 G, 81 A, 171

[56] References Cited

U.S. PATENT DOCUMENTS

| | | | |
|---|---|---|---|
| 3,075,768 | 1/1963 | Karns | 273/81 A |
| 3,330,560 | 7/1967 | Higdon | 273/171 |
| 3,487,518 | 1/1970 | Hopfeld | 273/73 C |
| 3,633,910 | 1/1972 | Spenle | 273/73 C |
| 4,057,250 | 11/1977 | Kuban | 273/73 G |
| 4,182,512 | 1/1980 | Kuebler | 273/73 C |
| 4,330,125 | 5/1982 | Sassler | 273/73 C |

FOREIGN PATENT DOCUMENTS

| | | | |
|---|---|---|---|
| 2106800 | 9/1971 | Fed. Rep. of Germany | 273/73 C |
| 8100214 | 2/1981 | World Int. Prop. O. | 273/73 C |

*Primary Examiner*—Edward M. Coven
*Assistant Examiner*—William E. Stoll

[57] ABSTRACT

A sports racket, especially a tennis racket, having reduced tendancy to transmit vibrational energy to the arm of the user, having a bow portion, and a hollow space within or surrounding said bow portion fully packed with spherical plastic beads such as low density polystyrene beads.

10 Claims, 1 Drawing Sheet

SHOCK AND VIBRATION ABSORBANT SPORTS RACKET

BACKGROUND OF THE INVENTION

1. Field of the Invention

The present invention is in the field of sports rackets, especially tennis rackets, and relates to improved vibration and shock absorbancy.

2. Description of the Prior Art

U.S. Pat. No. 4,057,250 describes a racket which has weight means which moves transverse to the plane of the racket stringing to provide inertial rebound deadening when the racket strikes a ball. A hollow container is mounted adjacent to the bow portion and is attached to transmit forces on the container directly to the racket, including a quantity of heavy, discrete, shot-like particles partially filling the container without substantial restraint in opposite dirtections along an axis extending generally along the intended direction of swing of the racket and generally perpendicular to the racket plane.

U.S. Pat. No. 4,364,564 discloses a shock absorber which has the same objective as the present invention but accomplishes it by filling a hollow wrist housing with a high density liquid such as mercury. This supposedly absorbs the vibrational effects of hitting the tennis ball.

The traditional wood sports rackets have been almost completely replaced by lighter aluminum rackets, or graphite-, fiberglass-, or ceramic-reinforced composite rackets. Aluminum and composite rackets are much more flexible than wood rackets and as a result have an undesirable tendancy to tramboline the ball. Some of this tendancy can be controlled by using a heavier guage aluminum. Composites such as graphite or ceramic are lighter, stronger, and stiffer than aluminum, and so less energy goes into flexing the racket and more goes into powering the ball. In spite of this advantage, excess energy is transferred via vibration or shock motion to the player's arm, resulting in "tennis elbow" in many cases. According to many experts, tennis elbow is caused in great part by the vibration and shock transmitted from the sports racket to the player's hand and continuing up the forearm to the elbow.

SUMMARY OF THE INVENTION

It is an object of the present invention to improve sports rackets so as to reduce vibration and shock resulting from striking the ball.

It is another object of the present invention to provide an improved sports racket which reduces shock and vibration reaching the player's arm while not adversely affecting play characteristics.

A still further object is to provide an improved tennis racket which maintains its power but reduces "tennis elbow."

These objects, and others as will become apparent from the following disclosure, are achieved by the present invention which comprises a sports racket having a frame fully filled with or surrounded by spherical plastic beads.

DESCRIPTION OF THE PREFERRED EMBODIMENTS

The racket of the present invention includes a composite frame having a hollow section in or surrounding the bow, filled with spherical plastic beads. The hollow section can be a continuous channel, multiple sections, or a plastic bag or tube within a hollow section of the bow. The hollow section filled with spherical plastic beads can also be within the throat and handle portions of the racket. The bow can be aluminum, but is preferably composite such as graphite, ceramic, boron fibers, fiberglass, or even composites with wood. Generally in the case of wood rackets, especially in the case of rackets which have previously been manufactured, the embodiment wherein a bead-containing channel is secured to the outside of the bow portion, is employed. This channel, 16 in FIGS. 3 and 4, can be added as a retrofit device, and adhered either by glue or by a squeeze fit due to the shape and resilience of the plastic of the channel.

In the case of normally hollow rackets such as aluminum, graphite or other composites, and the like, the channel filled with beads preferably also includes the throat and handle portions, i.e., the beads preferably fill the bow, throat, and handle (sometimes referred to as the grip).

The spherical plastic beads are the key to the invention. They are near perfect shock absorbers. The fact that they are near uniform spheres causes them to always occupy about 60% by volume of the hollow space, as is the case for any near uniform spheres within a cylinder-like space. About 40% of the space within the hollow portion, therefore, remains unfilled space, thus the beads never become so tightly packed as to behave as a solid. Mesh sizes between about 1 and 2 millimeters are expecially preferred. Sufficient packing so as to prevent any unrestrained movement of the beads within the space is a requirement of the invention to prevent vibration.

The beads can be any suitable plastic, the lighter the weight types being the most preferred, for example, polystyrene, polybutadiene, acrylic, PVC, butadiene, and the like. Glass beads or lead shot would not be suitable because they would be too heavy and would not absorb sufficient shock for their weight.

The racket of the invention is stiff and light like a graphite racket, but is far more vibration and shock absorbent due to the creation of hundreds of tiny billiard-ball like impacts within the racket frame when a ball is struck by the strings of the racket, which dissipate the shock due to the impact of the ball.

Figure 1:
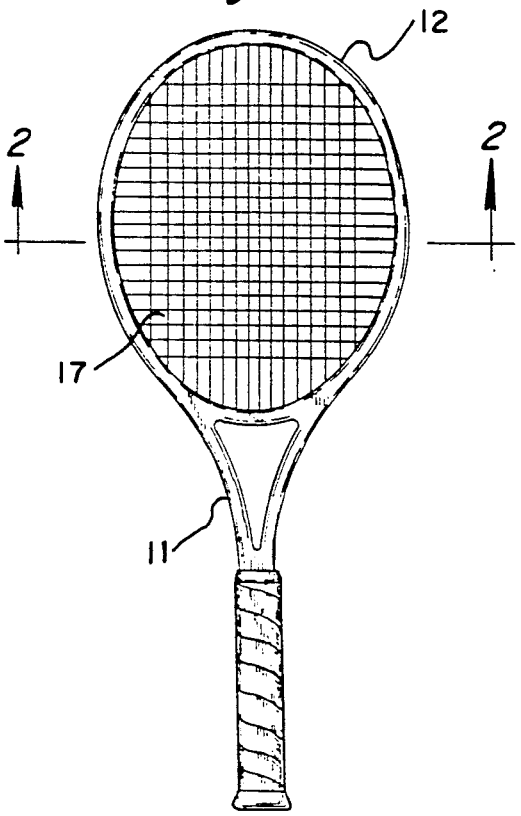
FIG. 1 is an elevational view of a sports racket according to the invention.
Figure 2:
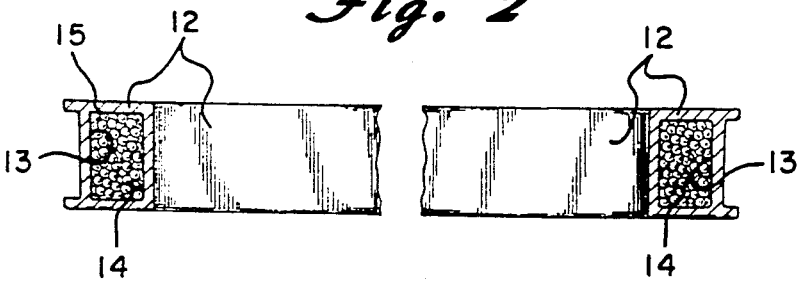
FIG. 2 is a sectional view through 2—2 of FIG. 1 showing the channel within the bow filled with spherical plastic beads.

Referring to the exemplary embodiment shown in FIG. 1, the sports racket 11 can be a tennis racket having a bow portion 12 and strings 17. The cross section illustrated in FIG. 2 shows a hollow space 13 within the bow portion fuly packed with spherical plastic beads 14 (strings deleted in FIGS. 2 and 4 for clarity). The beads in the preferred example are low density polystyrene, but can also be PVC, acrylic, butadiene, or any low density plastic spheres. The beads, as will any uniform sized spheres packed in a space, occupy about 60% of the space. In this example, a very thin, light weight plastic tube of polyethylene 15 is used to contain the beads to prevent them from leaking out through the grommet holes used for stringing. The racket is made lighter than ususual to compensate for the weight of the beads filling the channel, and so the overall weight of the tennis racket is about 11.5 to 13.5 ounces, typical for tennis rackets, preferably about 12 to 13 ounces.

Figure 3:
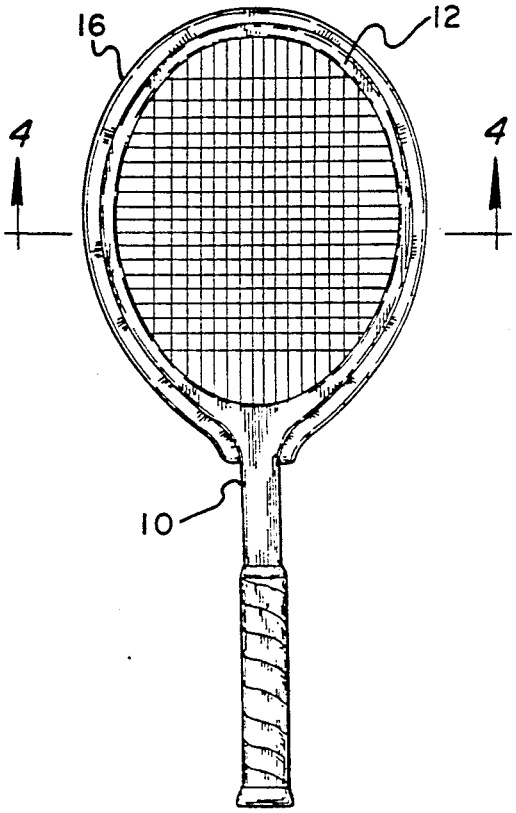
FIG. 3 is an elevational view of another embodiment of a sports racket according to the invention wherein a bead-containing channel surrounds the bow portion of the racket.

In the embodiment shown in FIG. 3, a bead-containing channel 16, formed from a rubber-like plastic such as polysiloxane rubber or polysulfone, surrounds the racket bow 12. This embodiment is prefered with wooden rackets 10 which are difficult to hollow out, or as a modification to existing composite rackets. The channel 16 would be sold as an accessory which can be added to a racket and either glued in place or held in place by the resilient effect of the plastic and a snug fitting design.

Figure 4:
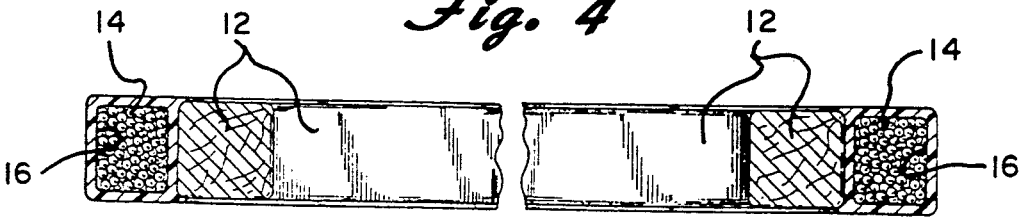
FIG. 4 is a sectional view through 4—4 of FIG. 3 showing the channel surrounding the bow portion of a solid wooden racket.

FIG. 4 shows a section through 4—4 of FIG. 3 wherein the channel 16 is shown snugly fit on the outside of the bow 12 (strings are deleted for clarity). The channel 16 is filled with spherical plastic beads 14.

While a few embodiments of the invention are described in detail herein, various alternatives, modifications, and improvements should become readily apparent to those skilled in the art without departing from the spirit and scope of the invention.

I claim:

1. A sports racket having reduced tendency to transmit vibrational energy to the arm of the user, having a bow portion, a throat, and a handle, spherical plastic beads, and a space or section within or outside said bow portion sufficiently fully packed with said plastic beads so as to prevent any unrestrained movement of the beads.

2. Sports racket according to claim 1 wherein said hollow space is within said bow portion.

3. Sports racket according to claim 1 wherein said hollow space is a continuous space within said bow portion, said throat, and said handle, all fully packed with said spherical plastic beads.

4. Sports racket according to claim 1 wherein said hollow space is within a channel surrounding said bow portion of said racket frame.

5. Sports racket according to claim 1 wherein said channel is formed by a tubular, light weight plastic bead-containing device attached to the outside circumfrence of said bow portion.

6. Sports racket according to claim 1 having weight, size, and dimensions suitable for tennis.

7. Sports racket according to claim 1 wherein said beads are selected from the group consisting of low density polystyrene, PVC, acrylic, and butadiene.

8. Sports racket according to claim 1 wherein said beads are so fully packed within said hollow space that said beads comprise about 60% of said space.

9. Sports racket according to claim 1 suitable for being strung and used for playing tennis.

10. Tennis racket according to claim 1 weighing between about 11.5 and 13.5 ounces.

* * * * *